US008308506B2

(12) United States Patent
Tang et al.

(10) Patent No.: US 8,308,506 B2
(45) Date of Patent: Nov. 13, 2012

(54) ULTRA-LOW CAPACITANCE HIGH VOLTAGE CABLE ASSEMBLIES FOR CT SYSTEMS

(75) Inventors: Liang Tang, Waukesha, WI (US); Yang Cao, Niskayuna, NY (US); Denis Perrillat-Amede, Buc (FR); Weijun Yin, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/012,648

(22) Filed: Jan. 24, 2011

(65) Prior Publication Data

US 2012/0190233 A1 Jul. 26, 2012

(51) Int. Cl.
*H01R 11/00* (2006.01)

(52) U.S. Cl. ..... 439/502

(58) Field of Classification Search ..... 439/502, 439/505, 578
See application file for complete search history.

(56) References Cited

U.S. PATENT DOCUMENTS

| | | | | |
|---|---|---|---|---|
| 1,984,526 | A * | 12/1934 | Given | 315/53 |
| 3,448,323 | A * | 6/1969 | Owens | 315/1 |
| 2004/0230271 | A1 * | 11/2004 | Wang et al. | 607/116 |
| 2004/0249428 | A1 * | 12/2004 | Wang et al. | 607/116 |
| 2008/0076854 | A1 * | 3/2008 | Sohal | 523/173 |

* cited by examiner

*Primary Examiner* — Jean F Duverne
(74) *Attorney, Agent, or Firm* — Fletcher Yoder

(57) ABSTRACT

The present embodiments relate to a cable assembly with ultra-low capacitance. In one embodiment, a cable assembly is provided. The cable assembly includes an insulation layer. The insulation layer includes a low-permittivity insulation material.

6 Claims, 2 Drawing Sheets

ULTRA-LOW CAPACITANCE HIGH VOLTAGE CABLE ASSEMBLIES FOR CT SYSTEMS

BACKGROUND OF THE INVENTION

The subject matter disclosed herein relates to high voltage cable assemblies, and in particular, to ultra-low capacitance cable assemblies for CT systems In non-invasive imaging systems, X-ray tubes are used in fluoroscopy, projection X-ray, tomosynthesis, and computer tomography (CT) systems as a source of X-ray radiation. Typically, the X-ray tube includes a cathode and a target. A thermionic filament within the cathode emits a stream of electrons towards the target in response to heat resulting from an applied electrical current, with the electrons eventually impacting the target. A steering magnet assembly within the X-ray tube may control the size and location of the electron stream as it hits the target. Once the target is bombarded with the stream of electrons, it produces X-ray radiation.

The X-ray radiation traverses a subject of interest, such as a human patient, and a portion of the radiation impacts a detector or photographic plate where the image data is collected. Generally, tissues that differentially absorb or attenuate the flow of X-ray photons through the subject of interest produce contrast in a resulting image. In some X-ray systems, the photographic plate is then developed to produce an image which may be used by a radiologist or attending physician for diagnostic purposes. In digital X-ray systems, a digital detector produces signals representative of the received X-ray radiation that impacts discrete pixel regions of a detector surface. The signals may then be processed to generate an image that may be displayed for review. In CT systems, a detector array, including a series of detector elements, produces similar signals through various positions as a gantry is displaced around a patient.

One method of imaging in CT systems includes dual energy imaging. In a dual energy application, data is acquired from an object using two operating voltages of an X-ray source to obtain two sets of measured intensity data using different X-ray spectra, which are representative of the X-ray flux that impinges on a detector element during a given exposure time. Since projection data sets corresponding to two separate energy spectra must be acquired, the operating voltage of the X-ray tube is typically switched rapidly.

One obstacle associated with CT systems using the fast voltage switching methods is the time required to charge and discharge the high voltage cable and the X-ray tube. Once a generator capacitance is reduced to an acceptable level, within the CT system, cable capacitance becomes a bottleneck that limits the further increase in switching frequency. Accordingly, a need exists for low capacitance high voltage cables for CT systems that will require less time to charge and discharge.

BRIEF DESCRIPTION OF THE INVENTION

In one embodiment, a high voltage cable assembly is provided that includes a cable having first and second ends, a first connector terminating the first end, and a second connector terminating the second end. The cable includes a protective jacket, an electromagnetic compatibility shield layer disposed inside the jacket, an outer semi-conducting layer disposed inside the electromagnetic compatibility shield layer, and a main cable insulating layer disposed inside the outer semi-conducting layer. The main cable insulating layer includes a low-permittivity insulation material. An inner cable core assembly is disposed inside the main cable insulating layer, and includes an inner semi-conducting layer, one or more filament conductors, one or more bias conductors, and one or more high voltage common conductors. The filament conductors, bias conductors, and high voltage common conductors are disposed inside the inner semi-conducting layer and are insulated from each other. In another embodiment, a high voltage cable assembly is provided that includes a cable having first and second ends, a first low capacitance connector terminating the first end and a second low capacitance connector terminating the second end. The cable includes a protective jacket, an electromagnetic compatibility shield layer disposed inside the jacket, an outer semi-conducting layer disposed inside the electromagnetic compatibility shield layer, a main cable insulating layer disposed inside the outer semi-conducting layer, and an inner cable core assembly disposed inside the main cable insulating layer. The inner cable core assembly includes an inner semi-conducting layer, one or more filament conductors, one or more bias conductors, and one or more high voltage common conductors. The filament conductors, bias conductors, and high voltage common conductors are disposed inside the inner semi-conducting layer and are insulated from each other. Additionally, the low capacitance connectors each include an internal cup and low permittivity material at least partially surrounding each cup.

In a third embodiment, a cable assembly is provided that includes a connection pipe and a cable core disposed inside the connection pipe. The cable core has a first and a second end. The cable core includes one or more bias conductors, one or more filament conductors, and one or more high voltage common conductors. The conductors are insulated from each other. Additionally, the cable assembly includes a first low capacitance connector which may receive the first end of the cable core in a first internal cup and a second low capacitance connector that may receive the second end of the cable core in a second internal cup. A low-permittivity insulation medium, more specifically vacuum or gas insulation, at least partially surrounds the first and second internal cups and surrounds the cable core inside the connection pipe.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

X-ray systems utilizing fast voltage switching capabilities are oftentimes limited in how fast voltage switching may occur, by the X-ray system cable capacitance. When switching voltages, a cable with high capacitance may cause the system to be unable to switch voltages in a timely manner.

In the present context, utilizing low-permittivity materials within the cable assembly and designing a cable aspect ratio and length that further reduces cable capacitance may have the effect of significant reduction in charging and discharging time within the cable, and thus speed up voltage switching within the X-ray system. Low-permittivity materials are materials that have very low dielectric constants, reducing capacitance. In preferred embodiments, the dielectric constants will be approximately 2.1-2.3, but may include any materials with a dielectric constant less than 2.8.

Figure 1:
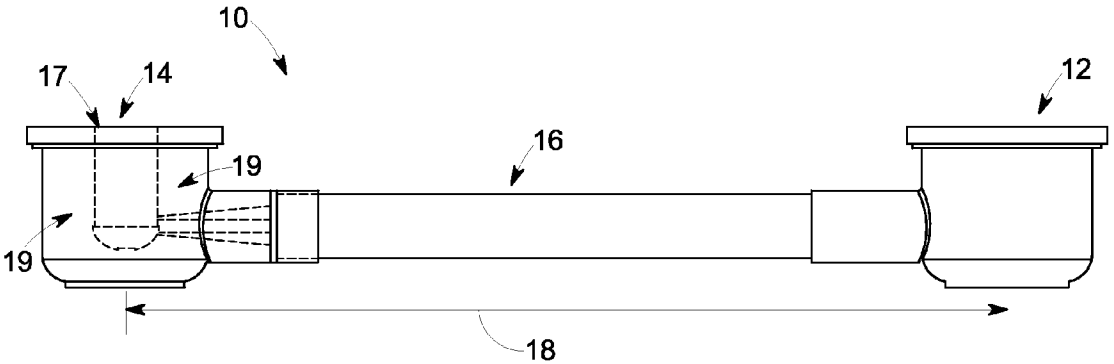
FIG. 1 is a side view of a cable assembly, in accordance with an embodiment of the invention.

Turning now to the figures, FIG. 1 is a side view of a connected cable assembly 10. Cable assembly 10 connects, through connector 12, to a power source assembly, which provides a high voltage power source for the X-ray system. The cable assembly 10 also connects to an X-ray tube through connector 14. The cable assembly 10 includes a high voltage cable 16,—high voltage connectors 12 and 14. As discussed in more detail below, the high voltage cable 16 may be a low capacitance cable, capable of fast voltage switching. In preferred embodiments, the cable capacitance of the high voltage cable 16 will be less than or equal to approximately 100 pF/m. One way in which the high voltage cable 16 may obtain a reduced capacitance, is through reducing the cable length 18. In preferred embodiments, the cable length 18 is reduced to approximately 0.5 meters, and in additional embodiments the cable length 18 could be as low as 200 millimeters. Additionally, the high voltage cable 16 is terminated by connectors 12 and 14. Connectors 12 and 14 each include an internal cup 17 configured to accept the ends of the cable 16. The connectors 12 and 14 may include low-permittivity materials 19 at least partially surrounding the internal cups 17. Examples of low permittivity materials may include materials such as unfilled epoxy, glass hollow sphere filled epoxy, or poly dicyclopentadiene (DCPD). When using glass hollow sphere filled epoxy, the glass hollow spheres must be surface treated due to their low density. Without a surface treatment, the glass hollow spheres have a tendency to float to the top of the epoxy, and thus are not well dispersed.

Figure 2:
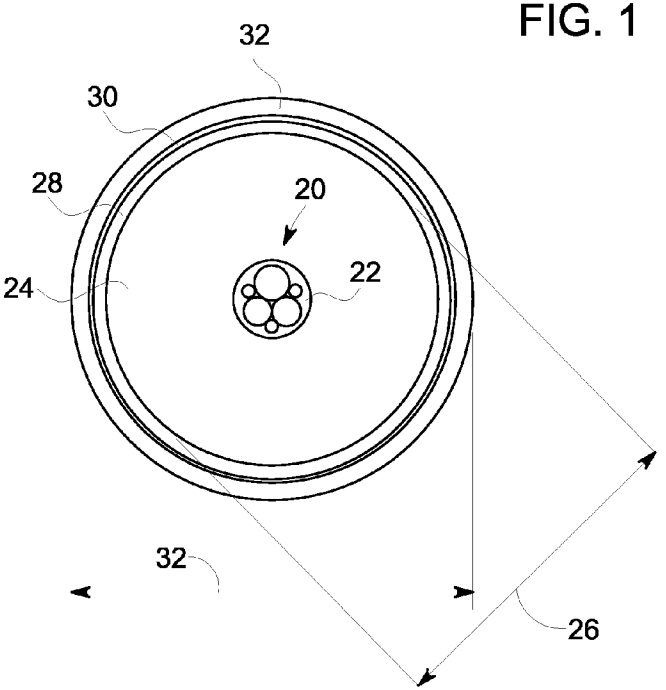
FIG. 2 is a cross-sectional view of the cable depicted in FIG. 1.

Various elements in the high voltage cable 16 can provide a low capacitance high voltage cable. FIG. 2 illustrates a cross-sectional view of the high voltage cable 16, demonstrating some of these techniques. The high voltage cable 16 includes an inner cable core assembly 20. The inner cable core assembly 20, which will be discussed in more detail below, houses an inner semi-conducting layer 22. The inner semi-conducting layer 22 provides protection to main cable insulating layer 24, surrounding the inner cable core assembly 20. The main cable insulating layer 24 consists of a low-permittivity rubber. Some examples of such a material include low-permittivity ethylene propylene rubber and fluorinated ethylene propylene. The outside edge of the main cable insulating layer 24 makes up an outer diameter 26 of the high voltage cable insulation. The main cable insulating layer 24 is surrounded by an outer semi-conducting layer 28, which provides protection to the main cable insulating layer 24. In a preferred embodiment, the outer semi-conducting layer 28 has approximately a 1 millimeter thickness. The outer semi-conducting layer 28 is surrounded by an electromagnetic compatibility (EMC) shield 30. In a preferred embodiment, the EMC shield 30 has approximately a 0.45 millimeter thickness. The electromagnetic compatibility shield 30 is surrounded by a protective jacket 32. In a preferred embodiment, the protective jacket 32 has approximately a 1.5 millimeter thickness and a diameter of 36 millimeters. Since the protective jacket 32 makes up the outer wall of the high voltage cable 16, the diameter of the high voltage cable 16 is also approximately 36 millimeters, in a preferred embodiment.

Figure 3:
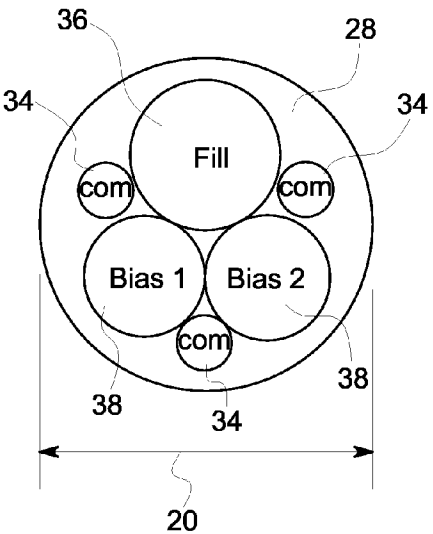
FIG. 3 is a magnified view of an inner cable core assembly.

FIG. 3 provides a cross-sectional view of the inner cable core assembly 20. The inner cable core assembly 20 includes one or more high voltage common conductors 34. Additionally the inner cable core assembly 20 houses a filament conductor 36 and bias conductors 38. The filament conductor 36 is an insulated wire that provides a driving current to filaments within the X-ray system. The filament conductor 36 may consist of one or more wires. The high voltage common conductors 38 are typically bare wires that provide a return path for filament driving current. The high voltage common conductors 34 may consist of one or more wires. The bias conductors 38 are insulated wires that provide several thousands of volts (up to 20 kV) to X-ray tube electrodes, enabling gridding or electrostatically controlling the focal spot in the X-ray tube. The filament conductor 36 and bias conductors 38 are insulated with ethylene tetrafluoroethylene (ETFE) and the bias conductors 38 are shielded with a metallization film. The high voltage common conductors 34, the filament conductor 36, and the bias conductors 38 are encapsulated in the inner semi-conducting layer 22. While the current embodiment depicts only one filament conductor 36, two bias conductors 38, and three common conductors 34, other embodiments may include fewer or more filament conductors 36, bias conductors 38, and common conductors 34.

Figure 4:
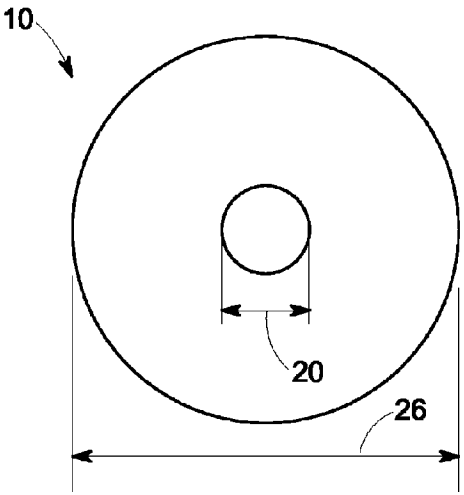
FIG. 4 is a schematic view of the aspect ratio of the main cable insulating layer to the inner cable core assembly.

Another factor that plays a role in overall cable capacitance, is the aspect ratio of the main cable insulating layer 26 and the inner cable core assembly 20, as shown in FIG. 4. The aspect ratio can be defined as the outer diameter 24/inner diameter of the inner cable core assembly. As the aspect ratio increases, the capacitance decreases. While in typical high voltage cable assemblies the aspect ratio is within 2.5 to 3, the ultra-low capacitance cable assembly described herein has an aspect ratio above 3.5. In a preferred embodiment, the main cable insulating layer 26 will be approximately 30 millimeters and the inner cable core assembly will be approximately 7 millimeters. This aspect ratio, when combined with the other techniques described herein, has been shown to produce a cable with capacitance at approximately 89 pF/m+/−10%.

Figure 5:
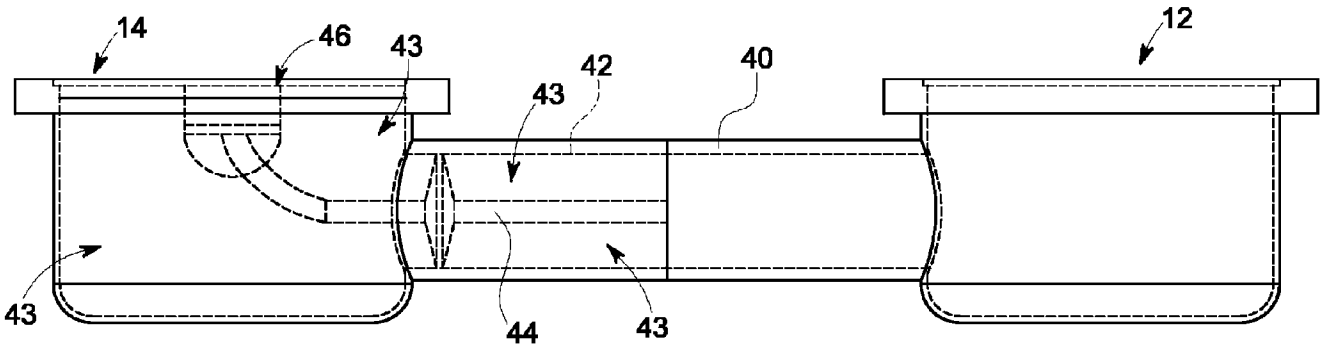
FIG. 5 is an embodiment of a cable assembly, illustrating a connection pipe insulation arrangement.

FIG. 5 illustrates an alternative embodiment of a high voltage cable assembly 10, utilizing a connection pipe 40 instead of a high voltage cable 16. The high voltage cable assembly 10 connects to a power source assembly and an X-ray tube via connectors 12 and 14 in a similar manner to the high voltage cable assembly 10 of FIG. 1. However, in this embodiment, the high voltage connection pipe 40 provides low-permittivity insulation through an insulation medium 43 disposed in the connectors 12 and 14 and inside the inner chamber 42 of the high voltage connection pipe 40. The insulation medium 43 may include vacuum insulation, insulating oil, compressed air, $SF_6$, or other insulating gases. A cable core 44, carrying the high voltage common conductors 34, the filament conductor 36, and the bias connectors 38 is disposed inside the inner chamber 42 and is surrounded by the insulation medium 43 in the inner chamber 42 of the connection pipe 40. The connectors 12 and 14 terminate the ends of the cable core 44. The cable core 44 passes into internal cups 46 of the connectors 12 and 14. The insulation medium 43 at least partially surrounds the internal cups 46 of the connectors 12 and 14.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A high voltage cable assembly comprising:

a cable having first and second ends and comprising a protective jacket, an electromagnetic compatibility shield layer disposed inside the jacket, an outer semi-conducting layer disposed inside the electromagnetic compatibility shield layer, a main cable insulating layer disposed inside the outer semi-conducting layer, and an inner cable core assembly disposed inside the main cable insulating layer, comprising an inner semi-conducting layer, one or more filament conductors, one or more bias conductors, and one or more high voltage common conductors, wherein filament conductors, bias conductors, and high voltage common conductors are disposed inside the inner semi-conducting layer and are insulated from each other;

a first low capacitance connector terminating the first end of the cable and comprising a first internal cup and a first low permittivity material at least partially surrounding the first internal cup; and a second low capacitance connector terminating the second end of the cable and comprising a second internal cup and a second low permittivity material at least partially surrounding the second internal cup.

2. The cable assembly of claim 1, wherein the cable assembly has a capacitance less than or equal to approximately 100 pF.

3. The cable assembly of claim 1 comprising an aspect ratio of the main cable insulating layer diameter and the cable inner cable core assembly diameter is above approximately 3.5 and/or the length of the cable assembly is approximately 0.5 meters or less.

4. The cable assembly of claim 3, wherein the main cable insulating layer diameter is approximately 30 mm and the cable inner cable core assembly diameter is approximately 7 mm.

5. The cable assembly of claim 1, wherein the first and second low-permittivity materials comprises unfilled epoxy.

6. The cable assembly of claim 1, wherein the first and second low-permittivity encapsulating materials comprises hollow sphere filled epoxy or poly dicyclopentadiene.

* * * * *